US009445628B2

(12) United States Patent
Merwin

(10) Patent No.: US 9,445,628 B2
(45) Date of Patent: Sep. 20, 2016

(54) HANDHELD WATERPIPE WITH SPILL RESISTANT CHAMBER

(71) Applicant: Kristian R. Merwin, Salt Lake City, UT (US)

(72) Inventor: Kristian R. Merwin, Salt Lake City, UT (US)

( * ) Notice: Subject to any disclaimer, the term of this patent is extended or adjusted under 35 U.S.C. 154(b) by 493 days.

(21) Appl. No.: 14/137,315

(22) Filed: Dec. 20, 2013

(65) Prior Publication Data

US 2014/0174457 A1 Jun. 26, 2014

Related U.S. Application Data

(60) Provisional application No. 61/740,683, filed on Dec. 21, 2012.

(51) Int. Cl.
*A24F 1/06* (2006.01)
*A24F 1/30* (2006.01)

(52) U.S. Cl.
CPC ..... *A24F 1/30* (2013.01)

(58) Field of Classification Search
USPC ..... 131/173, 276, 329, 330, 180, 211, 270, 131/273; 128/200.11, 200.12, 200.13
See application file for complete search history.

(56) References Cited

U.S. PATENT DOCUMENTS

| | | | | |
|---|---|---|---|---|
| 4,029,109 | A | 6/1977 | Kahler | |
| 4,241,741 | A | 12/1980 | Cabados et al. | |
| 6,481,437 | B1 | 11/2002 | Pate | |
| 6,935,345 | B2 | 8/2005 | Carstens et al. | |
| 9,027,565 | B2 | 5/2015 | Wagenhals | |
| 2007/0079839 | A1* | 4/2007 | Russon | A24F 1/30 131/173 |
| 2012/0199572 | A1 | 8/2012 | Shen et al. | |

* cited by examiner

*Primary Examiner* — Dennis Cordray
(74) *Attorney, Agent, or Firm* — Morris O'Bryant Compagni

(57) ABSTRACT

The present disclosure is directed to a handheld waterpipe for smoking, with a spill resistant water chamber. The central chamber may be formed as an enlarged tube having closed upper and lower ends. An upper tube extends from a top opening through the upper end and a lower tube extends from an upper opening inside the central chamber through the lower end. An inner chamber is formed inside the central chamber around the lower tube. One or more small openings are formed between the inner chamber and the central chamber. When liquid is placed into the central chamber, it passes through the small openings to form a continuous body of liquid between the two chambers. If the central chamber is tipped, the liquid resides within the chamber in a space between the upper and lower tubes and a sidewall of the central chamber, thereby preventing spilling.

18 Claims, 5 Drawing Sheets

HANDHELD WATERPIPE WITH SPILL RESISTANT CHAMBER

CROSS-REFERENCE TO RELATED APPLICATION

This application claims the benefit of U.S. Provisional Application No. 61/740,683, filed Dec. 21, 2012, the disclosure of which is incorporated herein by reference in its entirety.

TECHNICAL FIELD

The present disclosure relates to waterpipes for smoking and hookahs and more specifically to handheld waterpipes.

BACKGROUND

Hookahs and waterpipes for smoking typically utilize a chamber which is at least partially filled with water or another liquid. A source of smoke, such as bowl containing tobacco, is placed above or beside the chamber and is in communication with the chamber at a point under with surface of water via a tube. A smoker draws by inhaling through a tube in connection with the chamber above the level of the liquid, the vacuum pressure created draws smoke from the source of the smoke into the chamber where it passes through the liquid into the inhalation tube and is inhaled by a smoker. The water chamber is typically near the bottom of the device above a base on which the device sits during use. The smoke source is typically placed above the water chamber and connected thereto by a downward extending tube.

Tipping or bumping these known water pipes during use can result in a spill that needs to be cleaned up. In the event of such a spill, due to the exposure of the water to smoke, this can result in staining of clothing or objects on which the water is spilled. Thus, most such pipes are intended for stationary use.

A water pipe that is intended for handheld use and that is spill resistant would be an improvement in the art. Such a pipe that had interchangeable tips for different uses would be a further improvement in the art.

SUMMARY

The present disclosure is directed to a handheld water pipe for smoking, with a spill resistant water chamber. The central chamber may be formed as an enlarged tube having closed upper and lower ends. An upper tube extends from a top opening through the upper end of the central chamber where it terminates in a bottom opening inside the central chamber nearer the upper end. A lower tube extends from an upper opening inside the central chamber through the lower end of the central chamber. The lower tube may terminate at a bottom end in a junction for the attachment of various tips.

An inner chamber is formed inside the central chamber around the lower tube, as by a sidewall extending from the lower end of the chamber wall around and over the lower tube to form a chamber therebetween, as by a covering dome extending from the lower end over the lower tube. One or more small openings are formed between the inner chamber and the central chamber near the closed lower end. When liquid is placed into the central chamber, it passes through the small openings to form a continuous body of liquid between the two chambers preventing airflow therethrough except by passage through the liquid. If the central chamber is tipped, or laid on its side, the liquid resides within the chamber in a space between the upper and lower tubes and a sidewall of the central chamber, thereby preventing spilling.

DESCRIPTION OF THE DRAWINGS

It will be appreciated by those of ordinary skill in the art that the various drawings are for illustrative purposes only. The nature of the present disclosure, as well as other embodiments, may be more clearly understood by reference to the following detailed description, to the appended claims, and to the several drawings.

DETAILED DESCRIPTION

The present disclosure relates to apparatus, systems and methods related to smoker's accessories such as hookahs and waterpipes. It will be appreciated by those skilled in the art that the embodiments herein described, while illustrative, are not intended to so limit the scope of the appended claims. Those skilled in the art will also understand that various combinations or modifications of the embodiments presented herein can be made without departing from the scope of this disclosure. All such alternate embodiments are within the scope of the appended claims.

Figure 2:
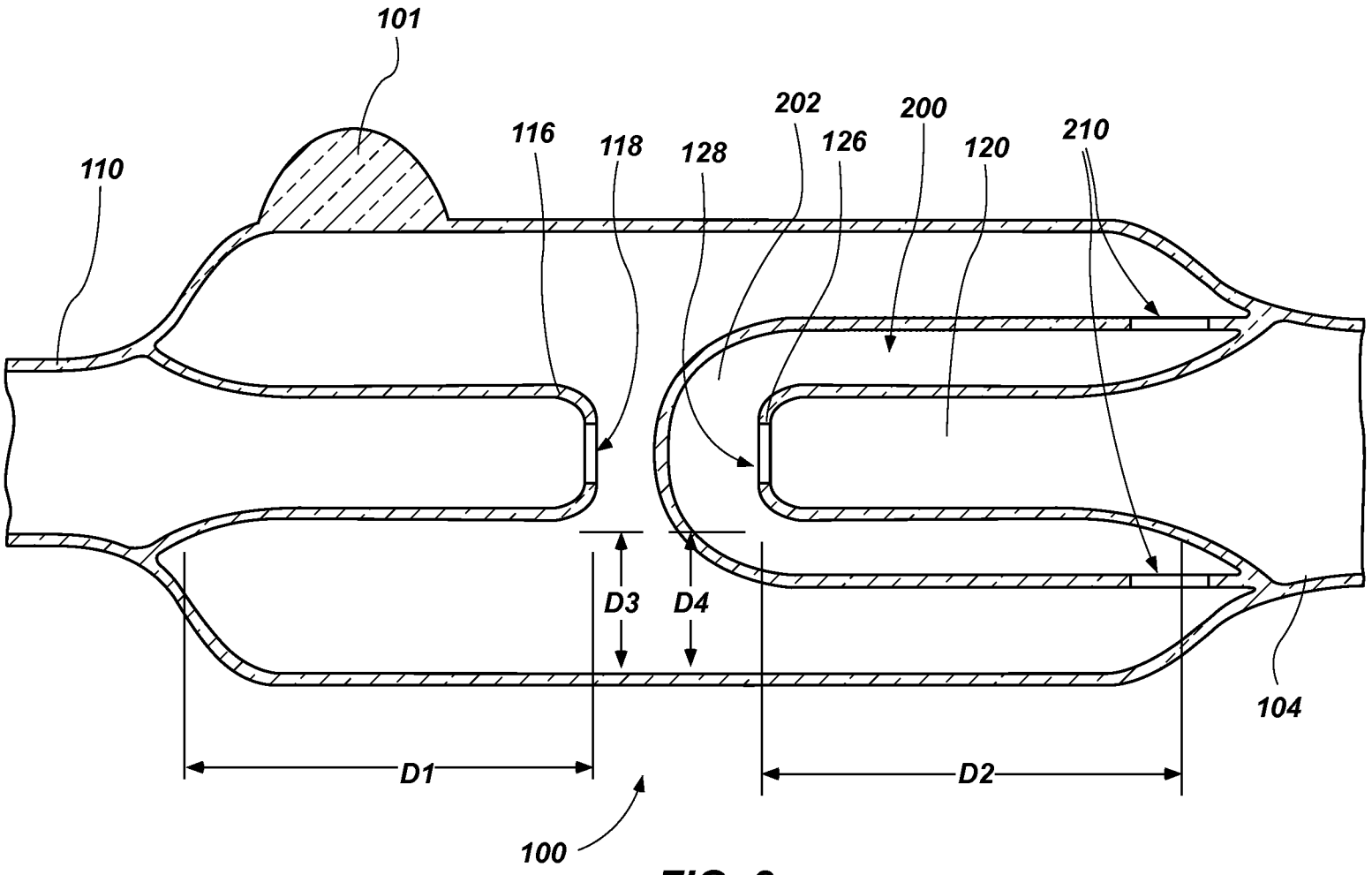
FIG. 2 is a side view photograph of the central chamber of FIG. 1, depicting some additional details thereof.

Referring to the drawing figures, a handheld water pipe 10 for smoking, with a spill resistant central chamber 100 is depicted. The central chamber 100 may be formed as an enlarged tube having a closed upper end 102 and a closed lower end 104. The chamber 100, including tubular sidewalls, upper end and lower end may be formed by one continuous structure, as depicted. An upper tube or inhalation tube 110 extends from a top opening 112, which may have a flange 114 or other structure for the comfort of a user, through the closed upper end 102 of the central chamber 100 where it terminates at an end 116 including a bottom opening 118 inside the central chamber 100 (as best depicted in FIG. 2). The upper tube 110 extends for a distance D1 inside the central chamber 100.

Figure 1:
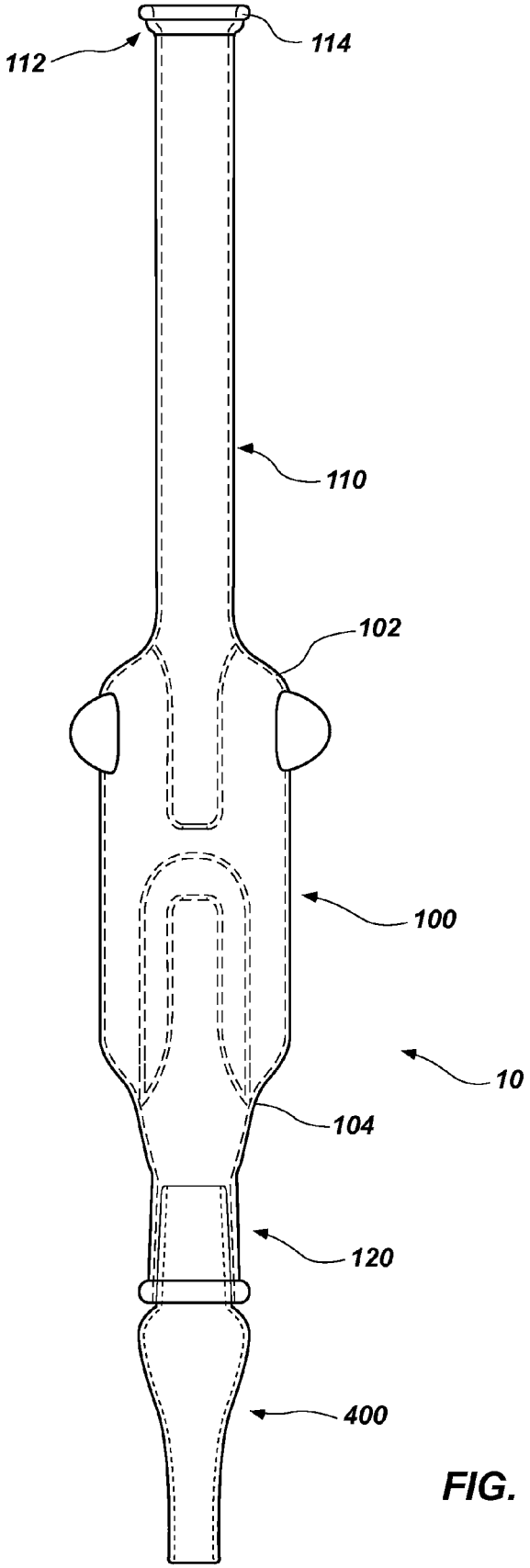
FIG. 1 is a side view of a first handheld water pipe in accordance with a first aspect of the present disclosure.
Figure 1A:
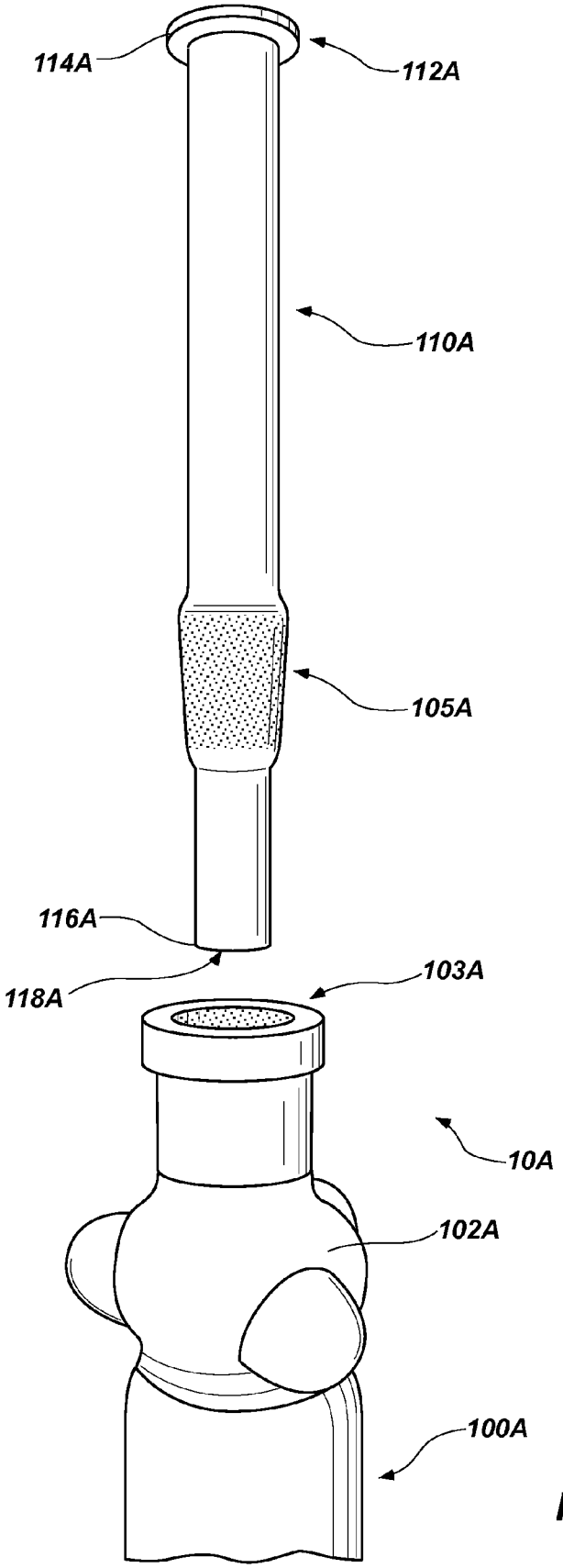
FIG. 1A is a side view of a first handheld water pipe in accordance with a first aspect of the present disclosure.

It will be appreciated that in some embodiments, the upper tube 110A may be formed as a removable piece that can be inserted into an opening 103A at the top of the central chamber 100, as depicted in FIG. 1A. In such embodiments, the upper tube 110A may have a connection portion 105A formed as a portion of the outer sidewall of the tube which is shaped as a tapered cylinder and has a non-polished surface, which may be roughened. The opening 103A of central chamber 100 may then have inner sidewall with a corresponding shape to the connection portion 105A and may similarly have a non-polished or roughened surface. The placement of the upper tube 110A in the opening 103A brings the connection portion 105A and the inner sidewall into contact, and the upper tube 110A may be retained in place by the friction therebetween. It will be appreciated that in other embodiments, the upper 110A may be connected to the central chamber 100 in another suitable fashion. Some other features depict in FIG. 1A are indicated with like reference numerals corresponding to the other FIGS. for clarity.

A lower tube or smoke tube 120 extends from an upper end 126 which includes an upper opening 128 inside the central chamber 100 through the closed lower end 104 of the central chamber. The lower tube 120 may terminate at a bottom end 140, which will be discussed in more detail in connection with FIGS. 3 and 4. The lower tube 120 extends for a distance D2 inside the central chamber 100.

An inner chamber 200 is formed inside the central chamber 100 around the lower tube 120, as by a sidewall extending from the lower end of the chamber wall around and over the lower tube to form chamber 200 therebetween, as by a covering dome 202 extending from the lower end 104 over the lower tube 120 within the central chamber 100. One or more small openings are formed between the inner chamber 200 and the central chamber 100 near the closed lower end 104. In the depicted embodiment, these openings are formed as slits 210 placed in the dome 202 near the closed lower end 104. It will be appreciated that the number and size of the openings may be varied as is useful for the particular embodiment. For example, in some embodiments, the openings may be formed as circles or ovals, or have a rectangular or irregular shape.

The number of openings or slits 210 may vary based on the desired airflow. In some embodiments, six or eight openings may be evenly spaced around the inner chamber 200.

For use, water or another desired liquid is placed into the central chamber 100 by being poured into the top opening 112 of upper tube 110 passing down the bore thereof and into the central chamber 100. The liquid will contact the upper surface of dome 202 and a portion of the liquid will pass through the small openings or slits 210 and into inner chamber 200 adjacent the base of the lower tube 120 at closed bottom end 104 to form a continuous body of liquid between the inner chamber 200 and outer chamber 100 preventing airflow therethough except by passage through the liquid.

The central chamber 100 and inner chamber 200 are constructed such that the volume of liquid required to cover the slits 210 and form a continuous body of liquid will fit within the space between the upper tube 110 and lower tube 120 and a sidewall of the central chamber 100 if the central chamber 100 or the pipe 10 is tipped, or laid on its side. This may be accomplished in different embodiments by varying the diameter of the central chamber in proportion to the diameter and length of portion of the upper and lower tubes within the chamber (D1 and D2), such that the space defined by the closed upper and lower ends of the central chamber 100, the sidewall of the central chamber 100 and the distances D3, and D4, between the sidewall of the tubes and the central chamber 100 sidewall has a volume that is at least equal to, but preferably greater than the volume of liquid required to cover the slits 210 when chambers 100 and 200 are in the upright position. Further, if the central chamber 100 or pipe 10 are turned upside down, the liquid will fit in the central chamber 100 in the space around the upper tube 110 without spilling back into the upper tube 110.

The outer sidewall of the central chamber 100 may include stops 101 for preventing the pipe 10 from rolling when placed on its side.

Figure 3:
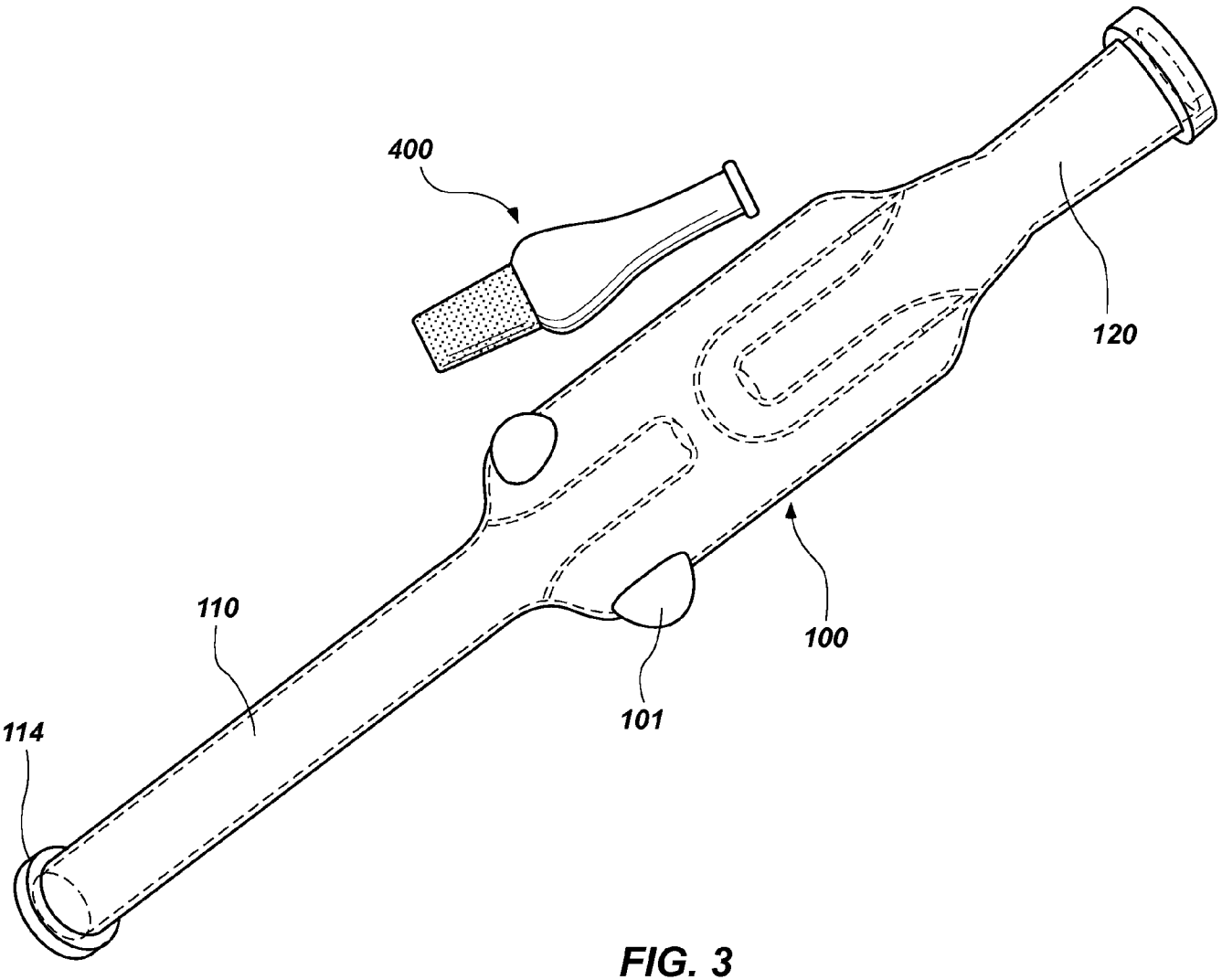
FIG. 3 is a perspective view of the pipe of FIG. 1 with the replaceable tip thereof in a removed position.
Figure 4:
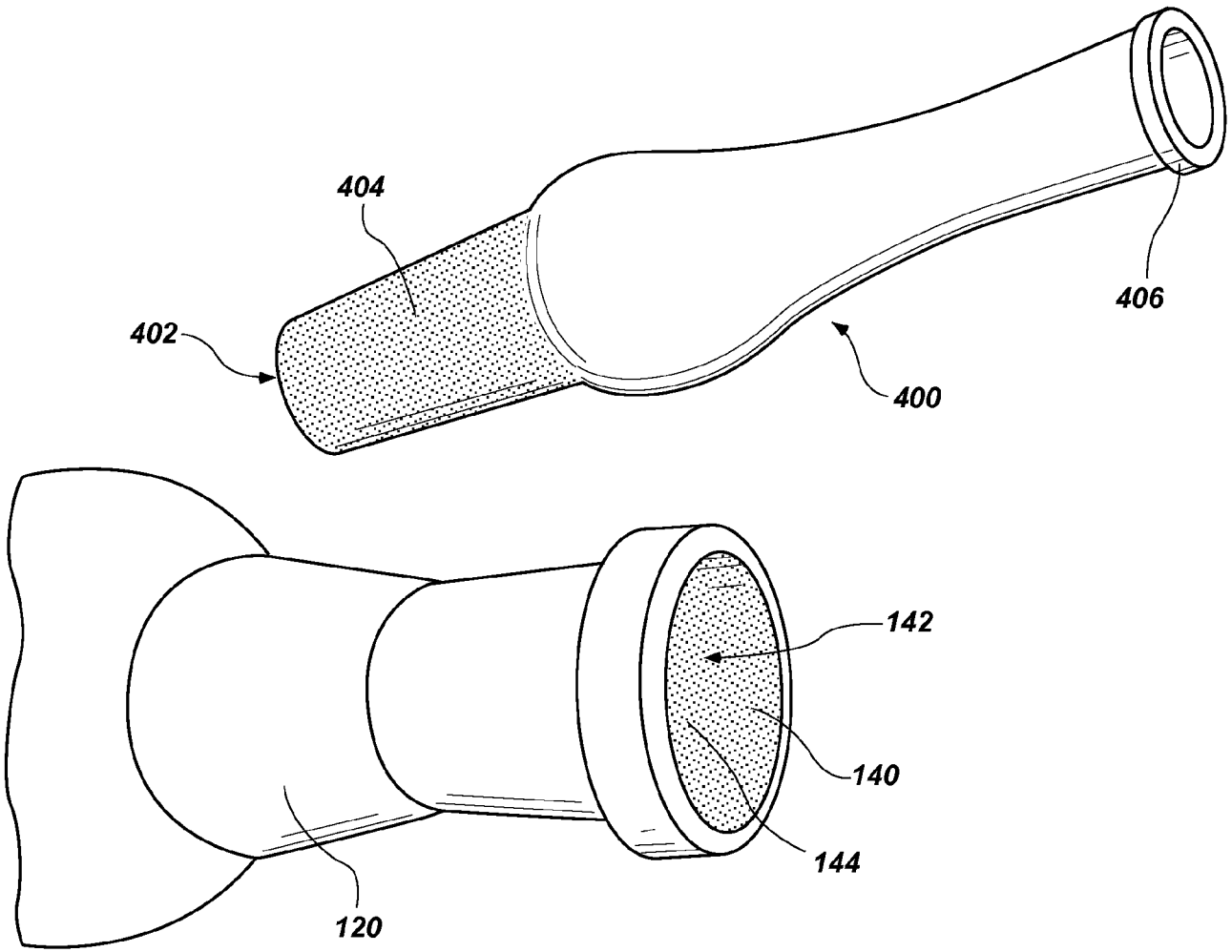
FIG. 4 is a perspective view of the removable tip and lower end of the pipe of FIGS. 1 through 3.

Turning to FIGS. 3 and 4, the pipe 10 is depicted with the removable tip 400 removed. As best depicted in FIG. 4, the bottom end 140 of lower tube 120 has a central opening 142 allowing access to the bore of the tube. The tip 400 may be attached and removed from the bottom end 140. This allows the tip to be replaced should it be damaged (as may happen to a tip made of a fragile material, such as the glass of the depicted tip 400) or may allow the use of multiple tips having different features. For example, the depicted tip 400 has a narrow opening 406 and may be entirely formed of glass. Such a tip may be used with essential oils, as by heating the tip and placing it into the oil to vaporize the oil for smoking. Other tips that include a bowl for placement of tobacco or other material for smoking may be used, allowing the pipe 10 to be used for multiple materials.

In other embodiments, the tip 400 may be formed from other suitable materials. For example, tips may be constructed of ceramic, steel, titanium, or other metals or materials having sufficient heat absorption and resistance properties.

The depicted tip 400 has a connection end 402, with an outer sidewall 404 formed as a tapered cylinder and having a non-polished surface, which may be roughened. The lower portion of the lower tube 120 has an inner sidewall 144 accessible through the opening 142. The inner sidewall 144 has a corresponding shape to the connection end 402 outer sidewall 404 of the tip 400 and may similarly have a non-polished or roughened surface. The placement of the connection end 402 into the opening 142 brings outer sidewall 404 and inner sidewall 144 into contact, and the tip 400 is retained in place by the friction therebetween. It will be appreciated that in other embodiments, the tip 400 may be connected to the tube 120 in another suitable fashion. For example, in some embodiments, the tip 400 and lower tube 120 may include threads and the tip 400 simply turned place.

It will be appreciated that rather than a connection to a tip, the chamber 200 may be used as an "inline" condenser attached to another source of smoke. For example, the inhalation tube of a hookah could be attached to lower tube 120 providing a second water passage for inhaled smoke for a user.

It is noted that while known water pipes and hookahs typically place the source of the smoke, such a bowl for burning tobacco, above the lower end of the water chamber and smoke is downwards into the water chamber through tubing. By contrast, in pipes in accordance with the present disclosure, the pipe is held in a generally vertical direction for smoking. Thus, the source of the smoke is placed underneath the central chamber 100 and the smoke directly rises as the pipe 10 is used in a linear fashion. This may allow for a pipe 10 to be constructed with a smaller cross-sectional shape, saving space and using less material.

It will be appreciated that the pipe 10, including chamber 100 and tips 400 and chamber 200 may be formed from glass, such as the depicted blown glass. Other suitable materials may be used as is desired for particular applications. For example, as discussed previously herein the tips 400 may be made from titanium or ceramic and the chamber 100 could be constructed from a suitable polymer material or metal.

While this invention has been described in certain embodiments, the present invention can be further modified with the spirit and scope of this disclosure. This application is therefore intended to cover any variations, uses, or adaptations of the invention using its general principles. Further, this application is intended to cover such departures from the present disclosure as come within known or customary practices in the art to which this invention pertains and which fall within the limits of the appended claims.

What is claimed is:

1. A spill resistant water chamber for a smoking pipe, comprising:

an upper end, including an opening with an inner sidewall;

a lower end;

a sidewall connecting the upper end and the lower end to form an enclosed central chamber;

an upper tube extending from a top opening through the upper end into the central chamber and extending into the central chamber for a first distance to an open bottom, the upper tube comprising a replaceably removable member and including a connection portion with an outer sidewall thereof formed with a shape corresponding to the inner sidewall of the opening in the upper end;

a lower tube extending from an upper opening inside the central chamber to the lower end for a second distance and then through the lower end to a bottom opening;

an inner chamber formed inside the central chamber around the lower tube; and at least one small opening formed between the inner chamber and the central chamber;

wherein the central chamber and the first distance and the second distance are sized such that a liquid may be placed into the central chamber in an amount where the liquid passes through the at least one small opening to form a continuous body of liquid between inner chamber and central chamber when the water chamber is in an upright position and if the central chamber is tipped to one side, the liquid will reside within the central chamber in a space between the upper tube and lower tube and the sidewall of the central chamber.

2. The spill resistant water chamber for a smoking pipe of claim 1, wherein the inner chamber includes a dome formed over the upper opening of the lower tube.

3. The spill resistant water chamber for a smoking pipe of claim 1, wherein the at least one small opening comprises a set of small openings.

4. The spill resistant water chamber for a smoking pipe of claim 3, wherein the inner chamber comprises an inner chamber sidewall extending from the lower end of the central chamber around and over the lower tube and the set of small openings are spaced around the inner chamber sidewall adjacent the lower end of the central chamber.

5. The spill resistant water chamber for a smoking pipe of claim 3, wherein the set of small openings comprises eight openings.

6. The spill resistant water chamber for a smoking pipe of claim 1, wherein the inner chamber comprises an inner chamber sidewall extending from the lower end of the central chamber around and over the lower tube and the at least one small opening comprises a slit formed in the inner chamber sidewall extending upwards from the lower end.

7. The spill resistant water chamber for a smoking pipe of claim 1, wherein the central chamber and the first distance and the second distance are sized such that a liquid may be placed into the central chamber in an amount where the liquid passes through the at least one small openings to form a continuous body of liquid between inner chamber and central chamber when the water chamber is in an upright position and if the central chamber is turned upside down, the liquid will fit in the central chamber in the space around the upper tube without spilling back into the upper tube.

8. The spill resistant water chamber for a smoking pipe of claim 1, wherein the connection portion of the upper tube is formed as a tapered cylinder.

9. A smoking pipe with a spill resistant water chamber, comprising:

a central chamber comprising an upper end, a lower end, and a surrounding sidewall connecting the upper end and the lower end to enclose the central chamber;

a lower tube extending from an upper opening inside the central chamber to the lower end for a second distance and through the lower end to a bottom opening;

an inner chamber formed inside the central chamber around the lower tube;

at least one small opening formed between the inner chamber and the central chamber;

an upper tube extending from a top opening through the upper end into the central chamber and extending into the central chamber for a first distance to an open bottom;

wherein the central chamber and the first distance and the second distance are sized such that a liquid may be placed into the central chamber in an amount where the liquid passes through the at least one small opening to form a continuous body of liquid between the inner chamber and the central chamber when the pipe is in an upright position and when the central chamber is tipped to one side, the liquid resides within the central chamber in a space between the upper tube and lower tube and the sidewall of the central chamber; and a removable tip for attachment at the bottom opening of the lower tube.

10. The smoking pipe of claim 9, wherein the inner chamber includes a dome formed over the upper opening of the lower tube.

11. The smoking pipe of claim 9, wherein the at least one small opening comprises a set of small openings.

12. The smoking pipe of claim 11, wherein the inner chamber comprises an inner chamber sidewall extending from the lower end of the central chamber around and over the lower tube and the set of small openings are spaced around the inner chamber sidewall adjacent the lower end of the central chamber.

13. The smoking pipe of claim 9, wherein the inner chamber comprises an inner chamber sidewall extending from the lower end of the central chamber around and over the lower tube and the at least one small opening comprises a slit formed in the inner chamber sidewall extending upwards from the lower end of the central chamber.

14. The smoking pipe of claim 9, wherein the central chamber and the first distance and the second distance are sized such that a liquid may be placed into the central chamber in an amount where passes through the at least one small openings to form a continuous body of liquid between inner chamber and central chamber when the water chamber is in an upright position and if the central chamber is turned upside down, the liquid will fit in the central chamber in the space around the upper tube without spilling back into the upper tube.

15. The smoking pipe of claim 9, wherein the removable tip has a narrow lower opening and is constructed of a material that may be heated for the vaporization of an essential oil.

16. The smoking pipe of claim 9, wherein the removable tip comprises a connection end with an outer sidewall formed as a tapered cylinder and a lower portion of the lower tube adjacent the bottom opening has an inner sidewall with a corresponding shape to the connection end to retain the tip by friction.

17. The smoking pipe of claim 9, wherein the removable tip is constructed of glass.

18. A smoking pipe with a spill resistant water chamber, comprising:

a central chamber comprising
an upper end,
a lower end, and
a surrounding sidewall connecting the upper end and the lower end to enclose the central chamber;

a lower tube extending from an upper opening inside the central chamber to the lower end for a second distance and through the lower end to a bottom opening;

an inner chamber formed inside the central chamber around the lower tube;

at least one small opening formed between the inner chamber and the central chamber;

an upper tube extending from a top opening through the upper end into the central chamber and extending into the central chamber for a first distance to an open bottom, the upper tube including a connection portion with an outer sidewall thereof formed as a tapered cylinder and the upper end includes an opening with an inner sidewall with a corresponding shape to the connection portion to retain the upper tube by friction; wherein the central chamber and the first distance and the second distance are sized such that a liquid may be placed into the central chamber in an amount where the liquid passes through the at least one small opening to form a continuous body of liquid between the inner chamber and the central chamber when the pipe is in an upright position and when the central chamber is tipped to one side, the liquid resides within the central chamber in a space between the upper tube and lower tube and the sidewall of the central chamber.

* * * * *